US009082547B2

(12) United States Patent
Yoshimori

(10) Patent No.: US 9,082,547 B2
(45) Date of Patent: Jul. 14, 2015

(54) AUTOMATIC WINDING MACHINE, AIR CORE COIL, AND WINDING METHOD OF THE SAME

(71) Applicant: SHT Corporation Limited, Osaka (JP)

(72) Inventor: Hitoshi Yoshimori, Osaka (JP)

(73) Assignee: SHT Corporation Limited, Osaka (JP)

( * ) Notice: Subject to any disclaimer, the term of this patent is extended or adjusted under 35 U.S.C. 154(b) by 0 days.

(21) Appl. No.: 14/029,530

(22) Filed: Sep. 17, 2013

(65) Prior Publication Data

US 2014/0028432 A1 Jan. 30, 2014

Related U.S. Application Data

(63) Continuation of application No. PCT/JP2012/056410, filed on Mar. 13, 2012.

(30) Foreign Application Priority Data

Mar. 18, 2011 (JP) ..... 2011-060706
Nov. 2, 2011 (JP) ..... 2011-240798

(51) Int. Cl.
*H01F 41/06* (2006.01)
*B21F 3/04* (2006.01)
*H01F 5/00* (2006.01)

(52) U.S. Cl.
CPC *H01F 41/06* (2013.01); *B21F 3/04* (2013.01); *H01F 5/00* (2013.01); *H01F 41/0633* (2013.01); *H01F 41/0687* (2013.01)

(58) Field of Classification Search
CPC ..... B21F 3/02; B21F 3/04; H01F 5/02; H01F 2005/025; H01F 41/06; H01F 41/0612; H01F 41/0633; H01F 41/065; H01F 41/0687
USPC ..... 72/135, 137, 138, 139, 142, 143, 145, 72/217, 218, 371; 29/605; 140/92.1, 92.2, 140/102
See application file for complete search history.

(56) References Cited

U.S. PATENT DOCUMENTS 2,251,776 A * 8/1941 Ballard ..... 140/92.2
2,426,090 A * 8/1947 Gartner ..... 29/605

(Continued)

FOREIGN PATENT DOCUMENTS

CN 1545711 11/2004 ..... H01F 41/08
CN 101226818 7/2008

(Continued)

OTHER PUBLICATIONS

International Preliminary Report on Patentability issued in corresponding foreign application, PCT/JP2012/056410, pp. 1-5 (Sep. 18, 2013).

(Continued)

*Primary Examiner* — Edward Tolan
(74) *Attorney, Agent, or Firm* — David G. Rosenbaum; J. Peter Paredes; Rosenbaum IP, P.C.

(57) ABSTRACT

An automatic winding machine has a rotation drive mechanism, four winding core shafts protruding from the drive mechanism and being rotated integrally with a rotation center of the drive mechanism, the winding core shafts whose axial centers are parallel to the rotation center, a reciprocating mechanism for reciprocating the winding core shafts, at least one pressing roller biased in the direction of bringing close to a rotation passage of the winding core shafts from the outer circumferential side, and a conductive wire supply mechanism for continuously supplying a conductive wire between the winding core shafts and the pressing roller.

7 Claims, 10 Drawing Sheets

(56) References Cited

U.S. PATENT DOCUMENTS

| | | | | |
|---|---|---|---|---|
| 2,640,451 | A * | 6/1953 | Carr | 72/50 |
| 2,683,474 | A * | 7/1954 | Langenberg | 140/88 |
| 3,525,147 | A * | 8/1970 | Kieffer | 29/596 |
| 3,538,959 | A * | 11/1970 | Eminger | 140/92.1 |
| 3,916,663 | A * | 11/1975 | Takeshita et al. | 72/135 |
| 4,139,932 | A * | 2/1979 | Hanert et al. | 29/890.035 |
| 4,355,478 | A * | 10/1982 | Armstrong | 140/92.1 |
| 4,870,742 | A * | 10/1989 | Roloff | 29/33 S |
| 5,887,632 | A * | 3/1999 | DeHart | 140/92.1 |
| 6,223,784 | B1 * | 5/2001 | Kirschner | 140/92.2 |
| 6,564,832 | B2 * | 5/2003 | Barrera | 140/92.2 |
| 7,185,413 | B2 * | 3/2007 | Kuroyanagi et al. | 29/596 |
| 8,371,340 | B2 * | 2/2013 | Fubuki et al. | 140/102 |
| 2004/0172806 | A1 | 9/2004 | Yoshimori | 29/605 |
| 2005/0212644 | A1 | 9/2005 | Yoshimori | 336/224 |
| 2008/0117012 | A1 | 5/2008 | Pilniak et al. | 336/205 |

FOREIGN PATENT DOCUMENTS

| | | | |
|---|---|---|---|
| EP | 1 414 051 | 4/2004 | H01F 41/08 |
| JP | 7-183152 | 7/1995 | H01F 41/06 |
| JP | 2000-277337 | 10/2000 | H01F 17/06 |
| JP | 2003-86438 | 3/2003 | H01F 27/28 |
| JP | 2006-339407 | 12/2006 | H01F 41/06 |
| WO | WO 03/005384 | 1/2003 | H01F 41/08 |
| WO | WO 03/105165 | 12/2003 | H01F 30/00 |

OTHER PUBLICATIONS

Chinese Office Action issued in corresponding foreign application, pp: 1-3 (Feb. 25, 2015).

* cited by examiner (a)

(b)

AUTOMATIC WINDING MACHINE, AIR CORE COIL, AND WINDING METHOD OF THE SAME

CROSS-REFERENCE TO RELATED APPLICATIONS

The present application claims priority from and is a continuation from PCT International Application No. PCT/JP2012/056410, filed Mar. 13, 2012, which claims priority from Japanese Patent Application Serial No. 2011-060706, filed Mar. 18, 2011 and Japanese Patent Application Serial No. 2011-240798, filed Nov. 2, 2011, all of which are incorporated by reference in their entireties.

BACKGROUND

The present invention relates to an automatic winding machine for manufacturing an air core coil insertable to a core installed in a rectifying circuit, a noise prevention circuit, a resonance circuit, and the like in various AC devices. The present invention also relates to an air core coil including a plurality of coil layers, and a winding method of the same.

A coil device installed in the rectifying circuit, the noise prevention circuit, the resonance circuit, and the like of the AC devices is formed by winding a coil around a core.

The applicant proposed a method of manufacturing a coil device by inserting an air core coil preliminarily wound in a spiral form to a core in which a gap is opened in the tangential direction from the gap (for example, refer to Patent Document 1: Japanese Patent Laid-open Publication No. 2000-277337).

An automatic winding machine of Patent Document 1 described above includes a pair of winding core members having a substantially rectangular section and being integrally rotated by a rotation drive mechanism, and manufactures an air core coil in which an inner circumferential length on the inner circumferential side of the core and an outer circumferential length on the outer circumferential side of the core are different by rotating while changing an interval between the winding core members and directly winding a conductive wire around the winding members.

As a method of manufacturing an air core coil in which an inner circumferential length and an outer circumferential length are different, a method of using a stepped winding jig corresponding to a hollow shape of the air core coil (Patent Document 2: Japanese Patent Laid-open Publication No. 2003-86438) and an automatic winding machine for winging a conductive wire around a winding core member while changing a form of the winding core member for each wire winding step of a unit wound portion (Patent Document 3: Japanese Patent Laid-open Publication No. 2006-339407) are known.

When the air core coil manufactured by an automatic winding machine of Patent Document 2 or 3 described above is installed to a core, a part of the conductive wire on the inner circumferential side of the core is overlapped in the radial direction, so that the conductive wire can be closely wound.

As shown in FIG. 15, an air core coil 200 in which unit coil portions 23 formed by winding a conductive wire 22 in a swirl form are repeatedly placed side by side in the winding shaft direction can be obtained.

As a winding method of such an air core coil 200, a method of forming a first unit wound portion 25, a second unit wound portion 26, and a third unit wound portion 27 having different inner circumferential lengths from each other continuously in the winding shaft direction by winding a conductive wire in a swirl form as shown in FIG. 16(*a*), and forming unit coil portions including the plurality of unit wound portions 25, 26, 27 continuously in the winding shaft direction, so as to manufacture an interim product of the air core coil, and then compressing the interim product in the winding shaft direction, pushing at least a part of the second unit wound portion 26 inside the third unit wound portion 27, and pushing at least a part of the first unit wound portion 25 inside the second unit wound portion 26 as in FIG. 16(*b*), so as to obtain a finished product of the air core coil including a plurality of coil layers (three layers in the example of the figure) is known (Patent Document 2).

SUMMARY OF THE INVENTION

An automatic winding machine configured to manufacture an air core coil in which unit coil portions formed by winding at least one conductive wire in a swirl form are repeatedly placed side by side in a winding shaft direction, each of the unit coil portions is formed by a plurality of unit wound portions having different inner circumferential lengths from each other, and when inserted to a core having a gap, at least a part of the unit wound portion having a small inner circumferential length is pushed inside the unit wound portion having a large inner circumferential length, the automatic winding machine comprising: a rotation drive mechanism; four winding core shafts protruding from the rotation drive mechanism and being rotated integrally with a rotation center of the rotation drive mechanism, the winding core shafts whose axial centers are parallel to the rotation center; a reciprocating mechanism for sliding and moving the winding core shafts between a first position where the axial centers of the winding core shafts serve as apex positions of a substantial rectangle surrounding the rotation center and two facing sides connecting the winding core shafts are an inner circumferential length and an outer circumferential length, and a second position where the axial centers of the winding core shafts serve as apex positions of a substantial trapezoid whose outer circumferential length is the same as the first position and whose inner circumferential length is long, so as to bring the winding core shafts close to or away from the rotation center of the rotation drive mechanism; at least one pressing roller biased in the direction of bringing close to a rotation passage of the winding core shafts from the outer circumferential side; and a conductive wire supply mechanism for continuously supplying the conductive wire between the winding core shafts and the pressing roller.

A winding method of an air core coil in which unit coil portions formed by winding at least one conductive wire in a swirl form are repeatedly placed side by side in the winding shaft direction, each of the unit coil portions is formed by a plurality of unit wound portions having different inner circumferential lengths from each other, at least a part of the unit wound portion having a small inner circumferential length is pushed inside the unit wound portion having a large inner circumferential length, and each of the plurality of unit wound portions forming the unit coil portion is formed in a polygonal shape having a plurality of corner parts, wherein a plurality of winding core mechanisms matching with the number of the polygonal corner parts is arranged around a rotation shaft serving as the winding shaft so as to be driven and rotated about the rotation shaft, a plurality of winding core pieces reciprocatable in the direction of crossing the winding shaft is installed in each of the winding core mechanisms, the winding method has a first step of setting the pluralities of winding core pieces of the winding core mechanisms at predetermined positions; and a second step of winding the conductive wire around the pluralities of winding core pieces forming the winding core mechanisms by rotating the plurality of winding core mechanisms in a state that the pluralities of winding core pieces are set at the predetermined positions, and the plurality of unit wound portions forming one of the unit coil portions is formed by repeating the first step and the second step while changing the positions of the pluralities of winding core pieces in the direction of bringing away from the rotation shaft or in the opposite direction thereof in a plane orthogonal to the rotation shaft.

The methods, systems, and apparatuses are set forth in part in the description which follows, and in part will be obvious from the description, or can be learned by practice of the methods, apparatuses, and systems. The advantages of the methods, apparatuses, and systems will be realized and attained by means of the elements and combinations particularly pointed out in the appended claims. It is to be understood that both the foregoing general description and the following detailed description are exemplary and explanatory only and are not restrictive of the methods, apparatuses, and systems, as claimed.

BRIEF DESCRIPTION OF THE DRAWINGS

In the accompanying figures, like elements are identified by like reference numerals among the several preferred embodiments of the present invention.

DETAILED DESCRIPTION OF THE INVENTION

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

A starting end of a conductive wire forming an air core coil is attached on a rotation drive mechanism side of a winding core member, and the wire is successively wound in the direction of bringing away from the rotation drive mechanism. Therefore, after the air core coil is manufactured, tasks of detaching the air core coil from the wire winding member and installing the starting end of the conductive wire to the winding core member are required again. Since these tasks are required every time when a predetermined length of air core coil is manufactured and there is a need for once stopping the automatic winding machine, an automatic winding machine capable of improving working efficiency is demanded.

In the air core coil manufactured by the automatic winding machine, not only the inner circumferential length is different but also the outer circumferential length is changed in accordance with the inner circumferential length. Therefore, when wound around the core, a part of the conductive wire on the coil outer circumferential side, the part having a long outer circumferential length is not closely attached to the coil, and there is a possibility that slack is generated.

A first object of the present invention is to provide an automatic winding machine capable of manufacturing an air core coil having unit wound portions which have different inner circumferential lengths but the same outer circumferential lengths.

Figure 13:
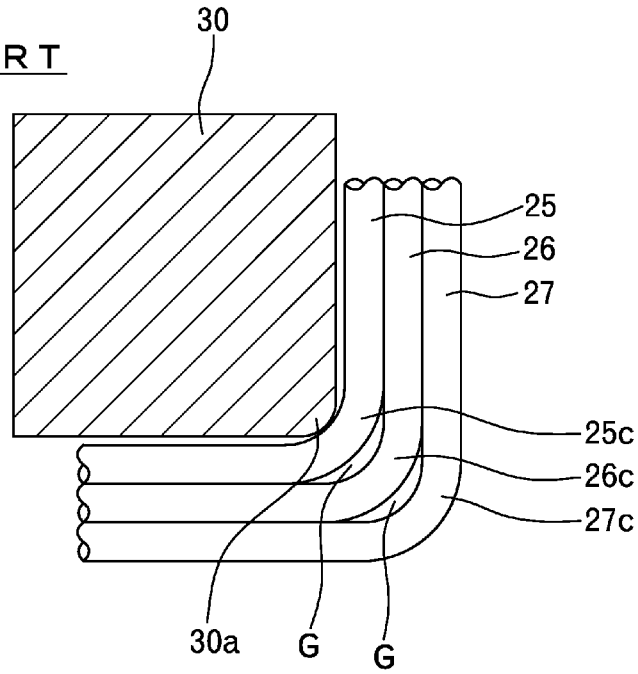
FIG. 13 PRIOR ART
FIG. 13 is a view showing gaps formed between bent parts of a plurality of unit wound portions in a conventional air core coil.

In the conventional winding method of the air core coil including the plurality of coil layers, by repeating a step of utilizing a corner part 30*a* of a winding core piece 30 and bending and deforming a conductive wire by about 90 degrees as shown in FIG. 13, bent parts 25*c*, 26*c*, 27*c* of the plurality of unit wound portions 25, 26, 27 forming the air core coil described above are formed. However, since the plurality of bent parts 25*c*, 26*c*, 27*c* formed by the corner part 30*a* of the same winding core piece 30 has arc shapes having the same curvature radius, spaces G are generated between the bent parts of the unit wound portions on the inner circumferential side and the outer circumferential side.

Accordingly, there is a problem that a space factor of the conductive wire in the air core coil is lowered.

Figure 14:
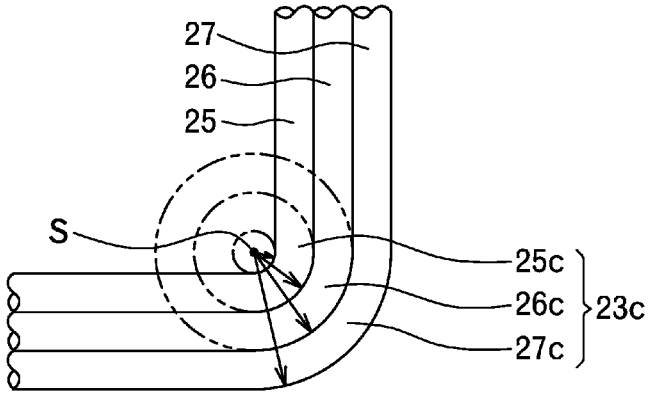
FIG. 14 is a view showing a closely connected state in an ideal structure that the bent parts of the plurality of unit wound portions are formed into a plurality of arc shapes having different curvature radiuses.

In order to solve this problem, as shown in FIG. 14, it is thought that in a corner part 23*c* of the air core coil, the bent parts 25*c*, 26*c*, 27*c* of the first unit wound portion 25, the second unit wound portion 26, and the third unit wound portion 27 are formed in arc shapes having the same curvature center S and curvature radiuses increased from the inner circumferential side toward the outer circumferential side by a diameter of the conductive wire.

Accordingly, the bent parts of the unit wound portions on the inner circumferential side and the outer circumferential side are closely connected to each other, so that the space factor of the conductive wire is increased.

However, in order to change an arc shape of the corner part for each unit wound portion, in the wire winding step of using the winding core piece 30 shown in FIG. 13, there is a need for preparing plural types of winding core pieces 30 having different curvature radiuses of outer circumferential surfaces of corner parts 30*a* and replacing the winding core pieces 30 for each unit wound portion. Automation of such a wire winding step is extremely difficult.

Thus, a second object of the present invention is to provide an air core coil capable of increasing a space factor of a conductive wire more than in the conventional example and a winding method capable of easily manufacturing such an air core coil.

In order to achieve the first object, an automatic winding machine of the present invention is an automatic winding machine for manufacturing an air core coil in which unit coil portions formed by winding at least one conductive wire in a swirl form are repeatedly placed side by side in the winding shaft direction, each of the unit coil portions is formed by a plurality of unit wound portions having different inner circumferential lengths from each other, and when inserted to a core having a gap, at least a part of the unit wound portion having a small inner circumferential length is pushed inside the unit wound portion having a large inner circumferential length, the automatic winding machine having a rotation drive mechanism, four winding core shafts protruding from the rotation drive mechanism and being rotated integrally with a rotation center of the rotation drive mechanism, the winding core shafts whose axial centers are parallel to the rotation center, a reciprocating mechanism for sliding and moving the winding core shafts between a first position where the axial centers of the winding core shafts serve as apex positions of a substantial rectangle surrounding the rotation center and two facing sides connecting the winding core shafts are an inner circumferential length and an outer circumferential length, and a second position where the axial centers of the winding core shafts serve as apex positions of a substantial trapezoid whose outer circumferential length is the same as the first position and whose inner circumferential length is long, so as to bring the winding core shafts close to or away from the rotation center of the rotation drive mechanism; at least one pressing roller biased in the direction of bringing close to a rotation passage of the winding core shafts from the outer circumferential side, and a conductive wire supply mechanism for continuously supplying the conductive wire between the winding core shafts and the pressing roller.

As specific mode, a pusher member arranged closely to the near side of the rotation direction of a position where the conductive wire supplied from the conductive wire supply mechanism is firstly abutted with any of the winding core shafts, the pusher member for pushing out the conductive wire wound around the winding core shafts to the free end side of the winding core shafts is desirably provided.

Further, in order to achieve the second object, in an air core coil of the present invention, unit coil portions formed by winding at least one conductive wire in a swirl form are repeatedly placed side by side in the winding shaft direction, each of the unit coil portions is formed by a plurality of unit wound portions having different inner circumferential lengths from each other, and at least a part of the unit wound portion having a small inner circumferential length is pushed inside the unit wound portion having a large inner circumferential length.

Each of the plurality of unit wound portions forming the unit coil portion is formed in a polygonal shape having a plurality of corner parts, each of all the corner parts of the unit wound portion is formed by a plurality of bent parts formed by bending the conductive wire at obtuse angle, and one or a plurality of connection parts for connecting the adjacent bent parts.

In the corner parts of the plurality of the unit wound portions forming the unit coil, the plurality of bent parts overlapping with each other at the same phase position is placed side by side on one straight line extending from the inner side to the outer side of the unit coil portion.

It should be noted that in the present invention, the air core coil has a concept including not only a coil in which a core does not exist in a space of a coil center part of a final product but also a coil in which a core exists in a space of a coil center part of a final product (coil device).

Specifically, in each of the corner parts, one straight line on which the plurality of bent parts formed in the plurality of unit wound portions, the bent parts overlapping at a first phase position are placed side by side, and one straight line on which the plurality of bent parts formed in the plurality of unit wound portions, the bent parts overlapping at a second phase position are placed side by side cross each other at one point on the inner side of the unit coil portion.

A winding method of an air core coil of the present invention is a winding method of the air core coil of the present invention in which a plurality of winding core mechanisms matching with the number of the polygonal corner parts is arranged around a rotation shaft serving as the winding shaft so as to be driven and rotated about the rotation shaft, a plurality of winding core pieces reciprocatable in the direction of crossing the winding shaft is installed in each of the winding core mechanisms, and the plurality of unit wound portions forming one of the unit coil portions is formed by repeating a first step of setting the pluralities of winding core pieces of the winding core mechanisms at predetermined positions and a second step of winding the conductive wire around the pluralities of winding core pieces forming the winding core mechanisms by rotating the plurality of winding core mechanisms in a state that the pluralities of winding core pieces are set at the predetermined positions, while changing the positions of the pluralities of winding core pieces in the direction of bringing away from the rotation shaft or in the opposite direction thereof in a plane orthogonal to the rotation shaft.

Specifically, upon forming continuous first and second unit wound portions, after forming the first unit wound portion, while pushing out the unit wound portion from outer circumferential surfaces of the pluralities of winding core pieces by the conductive wire to be the second unit wound portion, the conductive wire to be the second unit wound portion is wound on the outer circumferential surfaces of the pluralities of winding core pieces, and the second unit wound portion is formed.

Further specifically, after the plurality of unit coil portions is formed by repeating the first step and the second step, by compressing the unit coil portions in the winding shaft direction, at least a part of the unit wound portion having a small inner circumferential length is pushed inside the unit wound portion having a large inner circumferential length, and the air core coil including a plurality of coil layers is completed.

According to the automatic winding machine of the present invention, by integrally rotating the winding core shafts while reciprocating, a coil portion having the unit coil portions which include the unit wound portions having different inner circumferential lengths can be continuously manufactured.

In the coil portion manufactured by the automatic winding machine of the present invention, the substantially trapezoid unit wound portions having the changed inner circumferential lengths while having the same outer circumferential lengths as the substantially rectangular unit wound portions can be formed. Thus, when the obtained coil portion is inserted to the core having the gap, not only a part of the conductive wire can be overlapped on an inner circumferential surface of the core but also the conductive wire can be wound around an outer circumference of the core more closely than in the conventional example due to the same outer circumferential lengths.

The manufactured unit wound portions are successively pushed out to the free end side of the winding core shafts by the pusher member. Thus, unlike the conventional example, a task of attaching the conductive wire again to the automatic winding machine after the automatic winding machine is stopped and the coil portion is detached can be omitted.

Further, in the air core coil of the present invention, in an ideal structure that the pluralities of bent parts of the plurality of unit wound portions are formed in an arc shape, the corner part corresponds to a shape formed by approximating the arc shape by the polygonal shape (polygonal lines). Thus, the gaps between the bent parts in the corner part become smaller than in the conventional example, and the space factor of the conductive wire is increased.

First Embodiment

Figure 1:
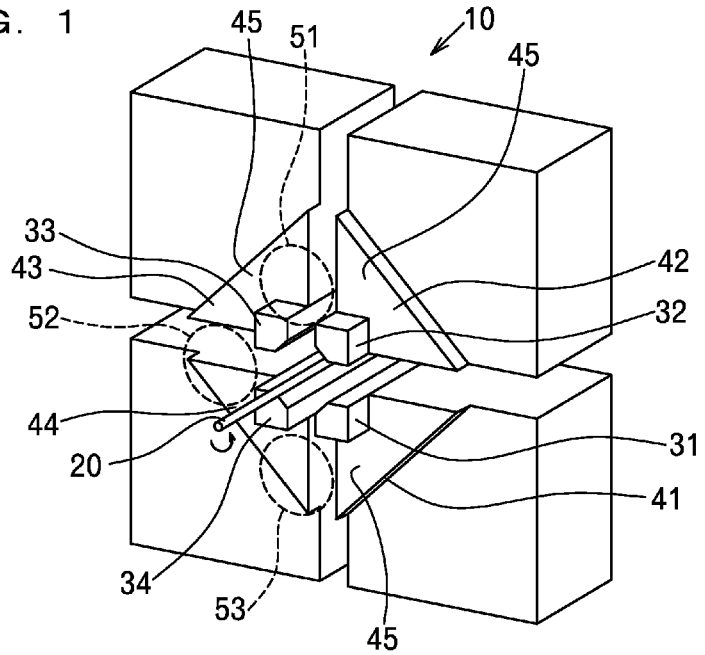
FIG. 1 is a perspective view showing major parts of an automatic winding machine according to a first embodiment of the present invention.
Figure 2:
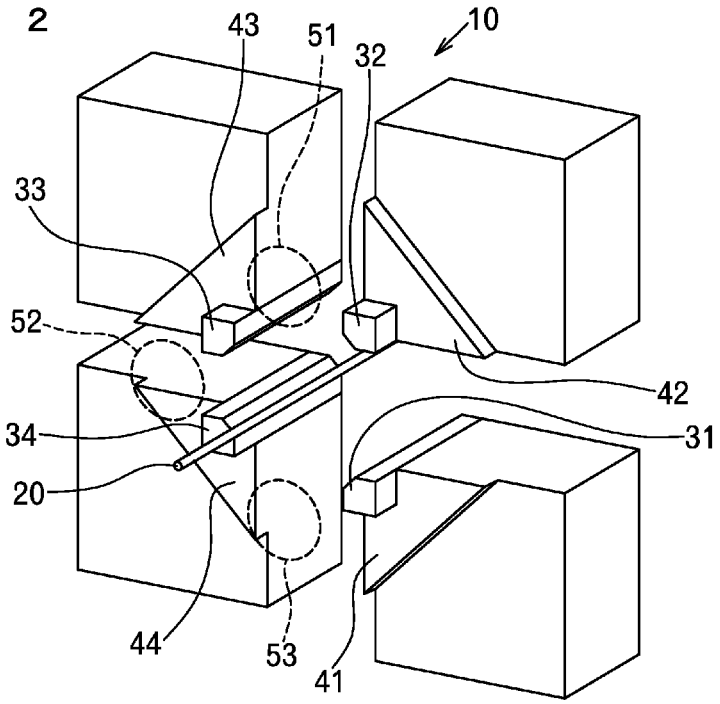
FIG. 2 is a perspective view showing a state that a plurality of winding core shafts is moved and rotated from a state of FIG. 1 in the automatic winding machine.
Figure 3:
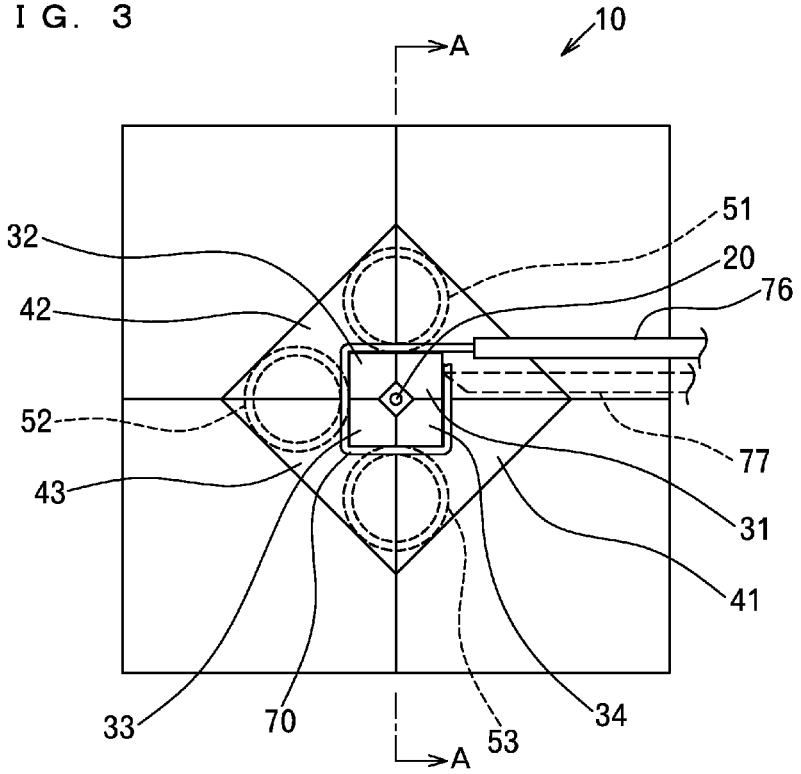
FIG. 3 is a front view showing major parts of the automatic winding machine.
Figure 4:
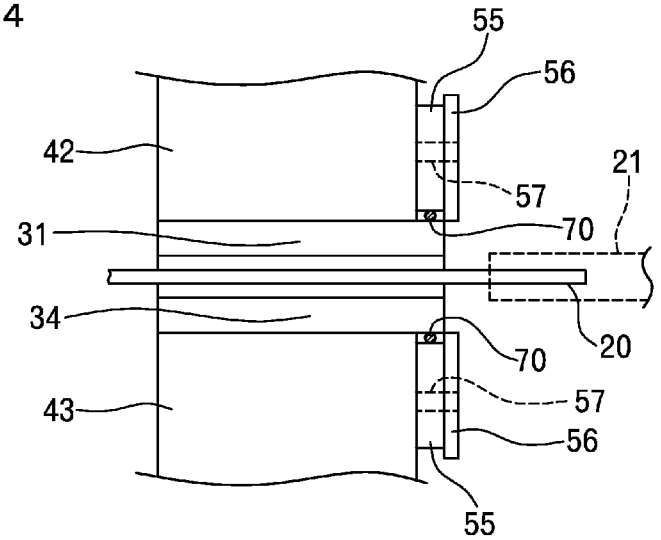
FIG. 4 is a sectional view along line A-A of FIG. 3.

FIGS. 1 and 2 are enlarged perspective views showing major parts of an automatic winding machine 10 serving as a first embodiment of the present invention, FIG. 3 is a plan view of the automatic winding machine 10, and FIG. 4 is a sectional view along line A-A of FIG. 3. The automatic winding machine 10 has a center foundation shaft 20 rotated anticlockwise as shown by the arrow direction in FIG. 1 by a rotation drive mechanism (not shown) such as a motor. Four winding core shafts 31, 32, 33, 34 rotated integrally with the center foundation shaft 20 are arranged around the center foundation shaft 20.

The winding core shafts 31, 32, 33, 34 are arranged so as to be rotated integrally with the center foundation shaft 20 and installed in slide blocks 41, 42, 43, 44 sliding so as to be brought close to and away from the center foundation shaft 20. More specifically, the winding core shafts 31, 32, 33, 34 are attached to corners of the slide blocks 41, 42, 43, 44 on the center foundation shaft 20 side, and leading ends thereof project from the slide blocks 41, 42, 43, 44. The winding core shafts 31, 32, 33, 34 can be square columns whose parts on the center foundation shaft 20 side are cut out. As described later, by making the slide blocks 41, 42, 43, 44 slide in parallel to the center foundation shaft 20, the winding core shafts 31, 32, 33, 34 can be brought close to and away from each other.

The leading ends of the winding core shafts 31, 32, 33, 34 protrude from leading end surfaces 45 of the slide blocks 41, 42, 43, 44 so as to be slightly longer than a diameter of a conductive wire 70. A protruding length of the winding core shafts 31, 32, 33, 34 is favorably 1 to 3 mm longer than the diameter of the conductive wire 70, and specifically, the protruding length is desirably about 2 to 5 mm.

One or a plurality of pressing rollers 51, 52, 53 is arranged on an outer circumference of a rotation passage of the winding core shafts 31, 32, 33, 34. In the present embodiment, as shown in FIG. 3, three pressing rollers 51, 52, 53 are arranged on the upper, lower, and left sides of the center foundation shaft 20 by 90, and biased in the direction of bringing close to the rotation passage of the winding core shafts 31, 32, 33, 34 by bias means such as a spring from a non-rotation casing (not shown) of the automatic winding machine 10.

More specifically, as shown in FIG. 4, each of the pressing rollers 51, 52, 53 has a thin and columnar pressing trunk portion 55 on the slide blocks 41, 42, 43, 44 side, and a disc shape pressing plate 56 formed on the near side of the pressing trunk portion 55, the pressing plate having a larger diameter than the pressing trunk portion 55. A width of the pressing trunk portion 55 desirably substantially matches with the protruding length of the winding core shafts 31, 32, 33, 34.

The pressing trunk portion 55 and the pressing plate 56 can be integrally formed. In the pressing trunk portion 55 and the pressing plate 56, a shaft hole 57 is opened through the center, and the bias means for biasing in the direction of bringing close to the rotation passage is connected to the shaft hole 57.

Between the upper pressing roller 51 and the rotation passage of the winding core shaft 32, the conductive wire 70 forming an air core coil is supplied from the upstream side of the rotation direction of the winding core shaft 31. The conductive wire 70 can be supplied by a conductive wire supply mechanism (not shown). As the conductive wire supply mechanism, a configuration that the conductive wire 70 is successively supplied from a tubular guide 76 whose leading end is opened between the upper pressing roller 51 and the rotation passage of the winding core shafts 31, 32, 33, 34 via a plurality of guide rollers (not shown) can be shown as an example.

On the lower side of an opening of the guide 76, that is, on the upstream side of the rotation direction, a pusher member 77 for pushing out the conductive wire 70 wound around the winding core shafts 31, 32, 33, 34 to the free end side of the winding core shafts 31, 32, 33, 34 is provided. The pusher member 77 is placed in the non-rotation casing (not shown) of the automatic winding machine 10 and arranged closely to the rotation passage of the winding core shafts 31, 32, 33, 34. It should be noted that as well as the pressing rollers 51, 52, 53, the pusher member is desirably biased in the direction of bringing close to the rotation passage of the winding core shafts 31, 32, 33, 34 by bias means or the like.

Further, as shown in FIG. 4, a winding assisting member 21 to which unit wound portions pushed out by the pusher member 77 are successively inserted is detachably fitted onto the center foundation shaft 20. The winding assisting member 21 can be made of, for example, resin, and a sectional shape thereof can be a substantially rectangular sectional shape to such an extent that the formed unit wound portion is easily fitted. A length of the winding assisting member 21 can be about 30 cm.

Figure 5:
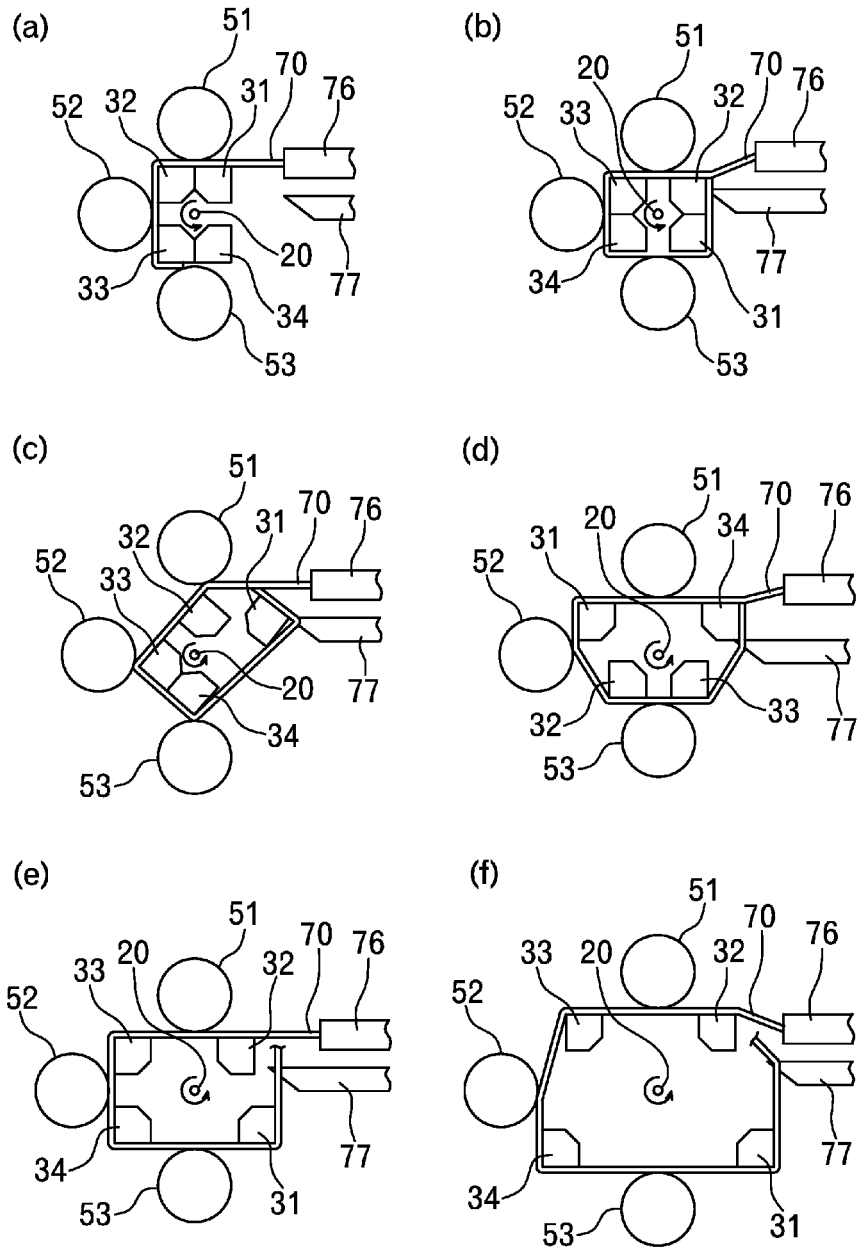
FIGS. 5(*a*) to (*f*) are a series of front views showing a wire winding step of using the automatic winding machine.

The automatic winding machine 10 with the above configuration has a reciprocating mechanism formed by a cam mechanism or the like, so that the rotated slide blocks 41, 42, 43, 44 can slide in the directions of bringing close or away in a plane orthogonal to axial centers of the winding core shafts 31, 32, 33, 34. More specifically, by the reciprocating mechanism, the slide blocks 41, 42, 43, 44 can slide while being integrally rotated about the center foundation shaft 20 between a state that the winding core shafts 31, 32, 33, 34 are positioned at apexes of an oblong as shown in FIG. 5(*a*), and a state that the winding core shafts 31, 32, 33, 34 are positioned at apexes of a trapezoid as shown in FIG. 5(*f*).

Hereinafter, a winding process of the conductive wire 70 of the automatic winding machine 10 of the present invention will be described. Firstly, in a state that the winding core shafts 31, 32, 33, 34 are positioned at apexes of an oblong as shown in FIG. 5(*a*), the conductive wire 70 is manually pulled out from the conductive wire supply mechanism (not shown) by a user, and the leading end of the conductive wire 70 is bent into a U shape and hanged onto an outer circumference of the winding core shafts 31, 32, 33, 34.

At this time, as shown in FIG. 4, the conductive wire 70 is surrounded by the winding core shafts 31, 32, 33, 34, the leading end surfaces 45 of the slide blocks 41, 42, 43, 44, and the pressing trunk portions 55 and the pressing plates 56 of the pressing rollers 51, 52, 53, so as not to be dropped off.

From this state, by actuating the rotation drive mechanism and actuating the reciprocating mechanism, winding of the conductive wire 70 is started.

When the winding core shafts 31, 32, 33, 34 are rotated as shown in FIG. 5(*b*) from the state shown in FIG. 5(*a*), the conductive wire 70 is wound around the winding core shafts 31, 32, 33, 34. When the winding core shafts 31, 32, 33, 34 are further rotated, the conductive wire 70 is bent while being pushed by the pressing trunk portions 55 of the pressing rollers 51, 52, 53, so that a unit wound portion 80 of an oblong which is a shape of the winding core shafts 31, 32, 33, 34 is formed.

When the winding core shafts 31, 32, 33, 34 are rotated by about 270 from start of winding of the conductive wire 70, as shown in FIG. 5(*b*), the conductive wire 70 is abutted with the pusher member 77, pushed out to the free end side of the winding core shafts 31, 32, 33, 34, and inserted to the winding assisting member 21 (refer to FIG. 4).

By rotating the winding core shafts 31, 32, 33, 34 by the predetermined number of times, for example twice, the conductive wire 70 becomes unit wound portions 80, 81 of double substantial oblongs. Next, by actuating the reciprocating mechanism while actuating the rotation drive mechanism, as shown in FIG. 5(*c*), while moving the winding core shaft 31 at the apex on one long side of the oblong in the direction of bringing away from the center foundation shaft 20, the winding core shafts 31, 32, 33, 34 are rotated. It should be noted that any of the winding core shafts 31, 32, 33, 34 at a position facing the guide 76 for supplying the conductive wire 70 is moved. This is because when the winding core shaft on which the conductive wire 70 is already wound is moved, the conductive wire 70 may be pulled and cut off or the like.

After the above process, by rotating the rotation drive mechanism, as shown in FIG. 5(*d*), the conductive wire 70 is pushed out by the pusher member 77 and the winding core shaft 34 on the other long side is also moved in the direction of bringing away from the center foundation shaft 20. As shown in FIG. 5(*e*), while rotating the winding core shafts 31, 32, 33, 34, the winding core shafts 32, 33 at the apexes of other long sides of the oblong are similarly moved in the direction of bringing away from the center foundation shaft 20 by a shorter distance than for the winding core shafts 31, 34. It should be noted that a position of the winding core shafts 31, 32, 33, 34 at this time is called as an interim position.

By rotating the winding core shafts 31, 32, 33, 34 in this state, a unit wound portion 82 having inner and outer circumferential lengths which are slightly longer than the oblong is formed.

Further, by successively moving the winding core shafts 31, 32, 33, 34 in the direction of bringing away from the center foundation shaft 20 further from the interim position while rotating the winding core shafts 31, 32, 33, 34, and rotating the winding core shafts 31, 32, 33, 34 while moving the winding core shafts 31, 32, 33, 34 to positions serving as apexes of a substantial trapezoid, the conductive wire 70 forms unit wound portions 83, 84 of a substantial trapezoid having outer and inner circumferential lengths which are longer than in the interim position as shown in FIG. 5(*f*). By rotating the winding core shafts 31, 32, 33, 34 by the predetermined number of times, for example twice, the conductive wire 70 becomes the unit wound portions 83, 84 of double substantial trapezoids.

Figure 6:
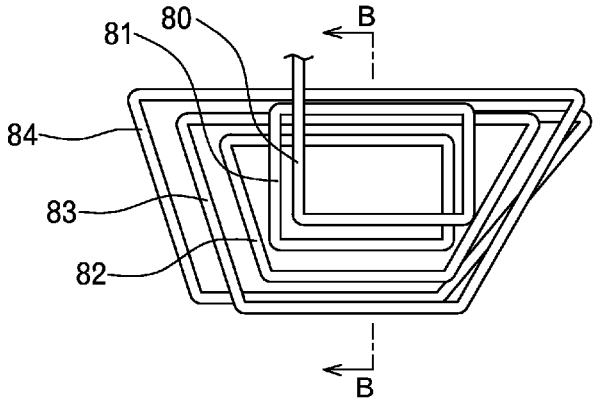
FIG. 6 is a front view of an air core coil manufactured by the automatic winding machine.
Figure 7:
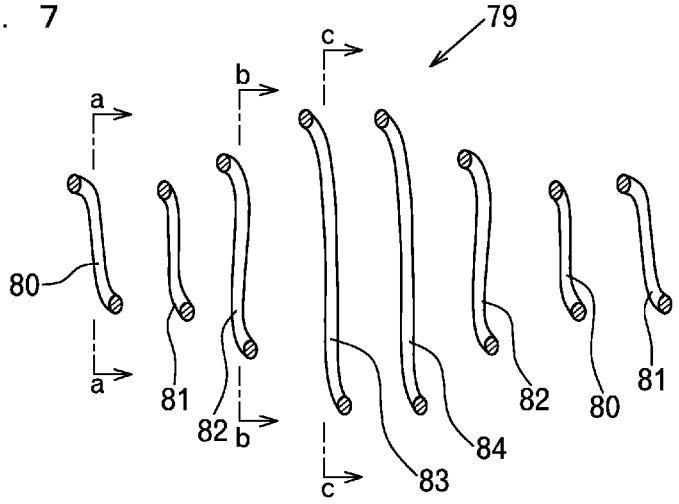
FIG. 7 is a sectional view along line B-B of FIG. 6.

Next, by rotating while successively returning the winding core shafts 31, 32, 33, 34 to the above interim position, further returning the winding core shafts 31, 32, 33, 34 to the positions where the winding core shafts 31, 32, 33, 34 become apexes of a substantial oblong as described above, and repeating an action of rotating by the predetermined number of times, a unit coil portion 79 in which the unit wound portions 80, 81, 82, 83, 84 as shown in FIGS. 6 and 7 are continued is wound around the winding assisting member 21, so as to become the air core coil.

When the air core coil having a predetermined length is formed, the automatic winding machine 10 is once stopped and the conductive wire 70 is cut off on the winding assisting member 21, so that the air core coil can be obtained. By actuating the automatic winding machine 10 again, manufacture of the air core coil is continued.

Figure 8:
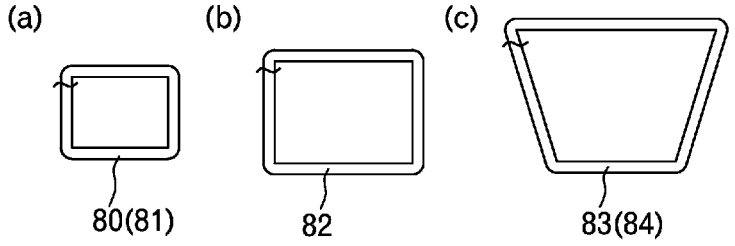
FIGS. 8(*a*) to (*c*) are sectional views respectively along lines a-a, b-b, c-c of FIG. 7.

FIGS. 6 to 8 show the manufactured air core coil. As shown in the figures, the air core coil has the three unit wound portions 80, 82, 83 having different inner circumferential lengths positioned on the inner circumferential side of a core 87 and different outer circumferential lengths positioned on the outer circumferential side of the core 87. The unit wound portions 80, 81 of a substantial oblong are wound twice, the unit wound portions 83, 84 of a substantial trapezoid are wound twice, and the unit wound portion 82 formed at the interim position is wound once respectively between both the unit wound portions 81, 83 and between both unit wound portions 82, 80.

Figure 9:
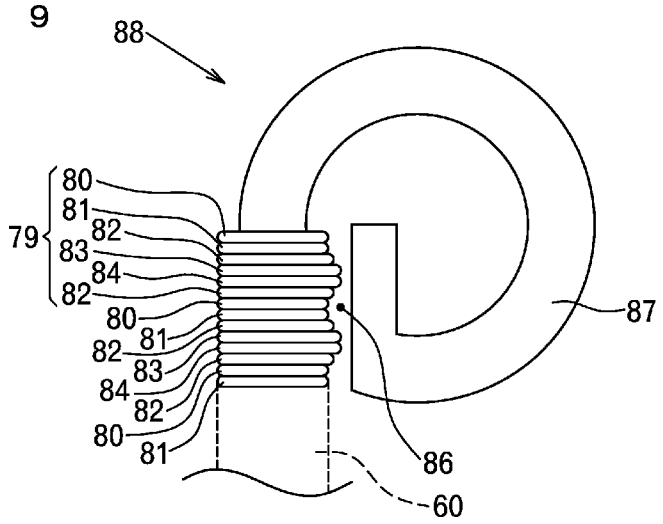
FIG. 9 is an illustrative view showing a state that the air core coil is inserted to a core.

The manufactured air core coil is inserted to the core 87 in which a gap 86 is opened in the connection direction as shown in FIG. 9 from the gap 86.

Figure 10:
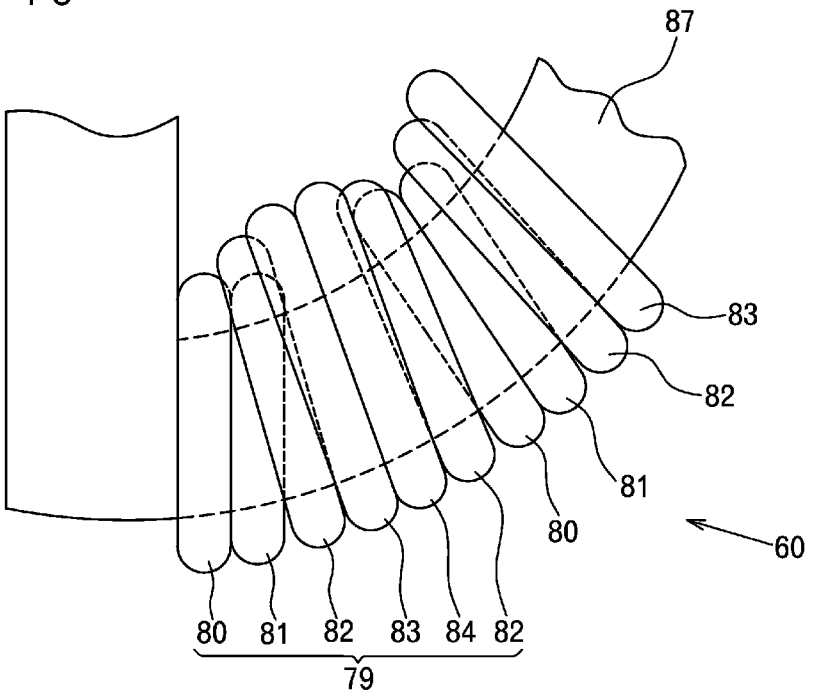
FIG. 10 is an enlarged view of major parts of a coil device.

Since the air core coil is formed by the unit wound portions 80, 82, 83 having different inner circumferential lengths, as shown in FIG. 10, the unit wound portions 83, 84 having long inner circumferential lengths stretch over the inner circumferential side of the unit wound portions 80, 81 having short inner circumferential lengths, so that a coil device 88 wound around the core 87 closely in comparison to the conventional example can be obtained.

Second Embodiment

Figure 11:
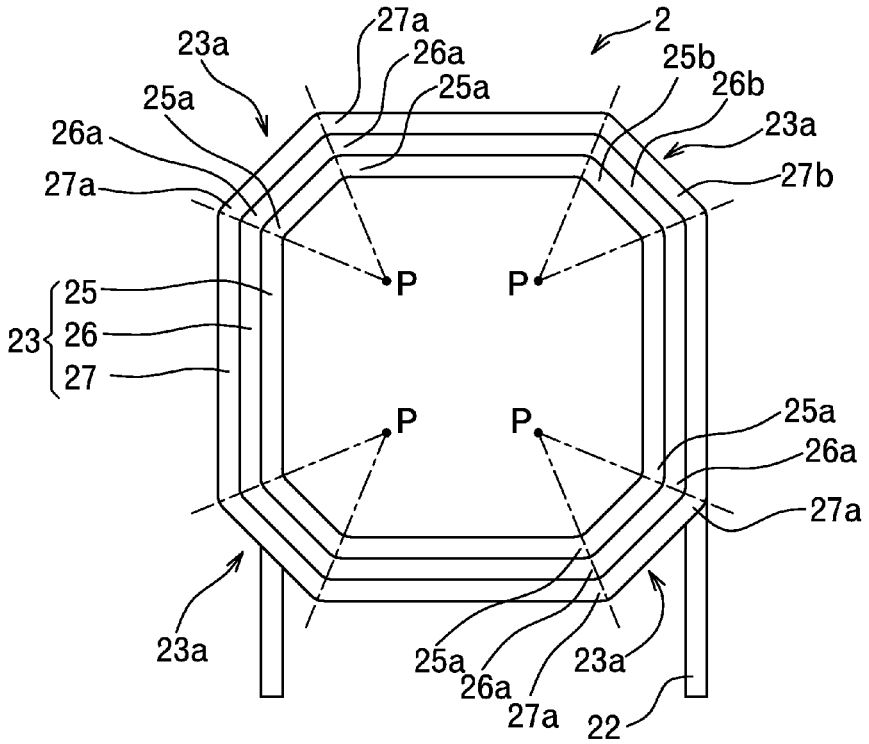
FIG. 11 is a front view of an air core coil according to a second embodiment of the present invention.
Figure 15:
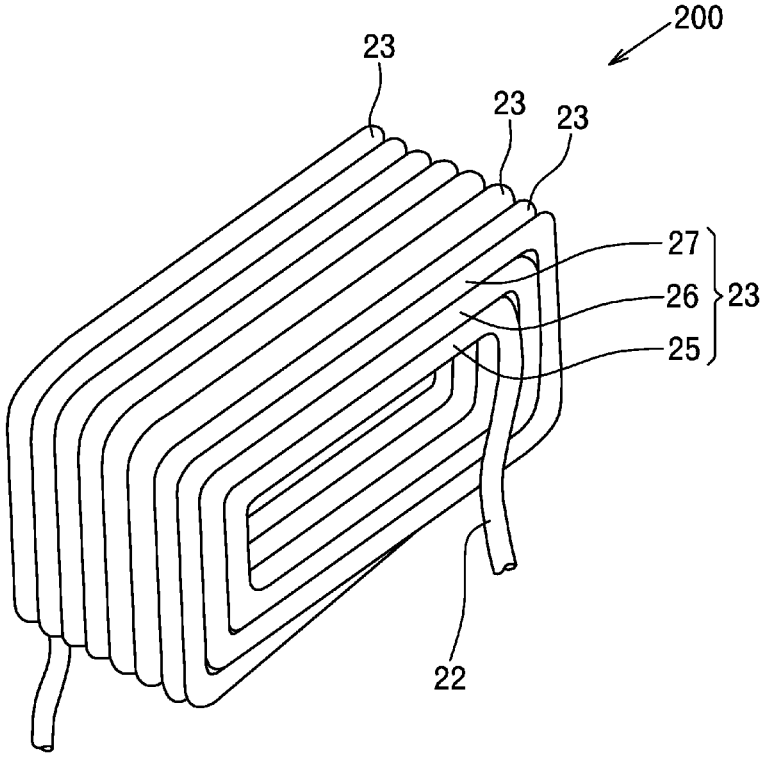
FIG. 15 PRIOR ART
FIG. 15 is a perspective view of the conventional air core coil.

Next, an automatic winding machine 1 of a second embodiment of the present invention will be specifically described along the drawings. FIG. 11 shows an air core coil 2 according to the present invention. The air core coil 2 according to the present invention has the basically same winding structure as an air core coil 200 shown in FIG. 15. A unit coil portion 23 formed by winding one conductive wire 22 in a swirl form along a plane orthogonal to a winding shaft as in FIG. 15 is continuously formed in the winding shaft direction, and whereby, the air core coil including three coil layers is formed.

As shown in FIG. 11, in the air core coil 2 according to the present invention, the entire unit coil portion 23 is formed into a substantial square having four corner parts 23*a*, 23*a*, 23*a*, 23*a*. A substantially entire length of a first unit wound portion 25 is pushed inside a second unit wound portion 26, and a substantially entire length of the second unit wound portion 26 is pushed inside a third unit wound portion 27.

In each of the corner parts 23*a* of the air core coil 2, the first unit wound portion 25 has two bent parts 25*a*, 25*a*, the second unit wound portion 26 has two bent parts 26*a*, 26*a*, and the third unit wound portion 27 has two bent parts 27*a*, 27*a*. A bent angle of the bent parts is set to be 45 degrees.

In the corner part 23*a*, the two bent parts 25*a*, 25*a* of the first unit wound portion 25 are connected to each other by a linear connection part 25*b*, the two bent parts 26*a*, 26*a* of the second unit wound portion 26 are connected to each other by a linear connection part 26*b*, and the two bent parts 27*a*, 27*a* of the third unit wound portion 27 are connected to each other by a linear connection part 27*b*.

In the corner part 23*a*, the three unit wound portions 25, 26, 27 in a corresponding positional relationship, that is, the three bent parts 25*a*, 26*a*, 27*a* at the same phase position are placed in line on a straight line extending from one point P.

As a result, in the corner part 23*a*, the conductive wire of the first unit wound portion 25 and the conductive wire of the second unit wound portion 26 are in contact with each other over substantially entire lengths, and the conductive wire of the second unit wound portion 26 and the conductive wire of the third unit wound portion 27 are in contact with each other over substantially entire lengths.

In other words, the corner part 23*a* of the air core coil 2 according to the present invention corresponds to a shape formed by approximating an arc shape of three bent parts 25*c*, 26*c*, 27*c* of a first unit wound portion 25, a second unit wound portion 26, and a third unit wound portion 27 shown in FIG. 14 by two or more polygonal shapes (polygonal lines). Thereby, the air core coil 2 according to the present invention has an intermediate configuration between the conventional air core coil 200 shown in FIG. 13 and the ideal air core coil shown in FIG. 14, and gaps between the bent parts in the corner part become smaller than the conventional example. As a result, the air core coil 2 according to the present invention have a space factor of the conductive wire larger than in the conventional air core coil 200 shown in FIG. 15.

The air core coil 2 according to the present invention can be easily manufactured with using an altered version of the automatic winding machine 10 used in the above first embodiment shown in FIGS. 1 to 4.

In the air core coil manufactured with using the automatic winding machine 10 of the first embodiment, gaps G are generated between the bent parts of the first unit wound portion 25, the second unit wound portion 26, and the third unit wound portion 27 as shown in FIG. 13.

Figure 12:
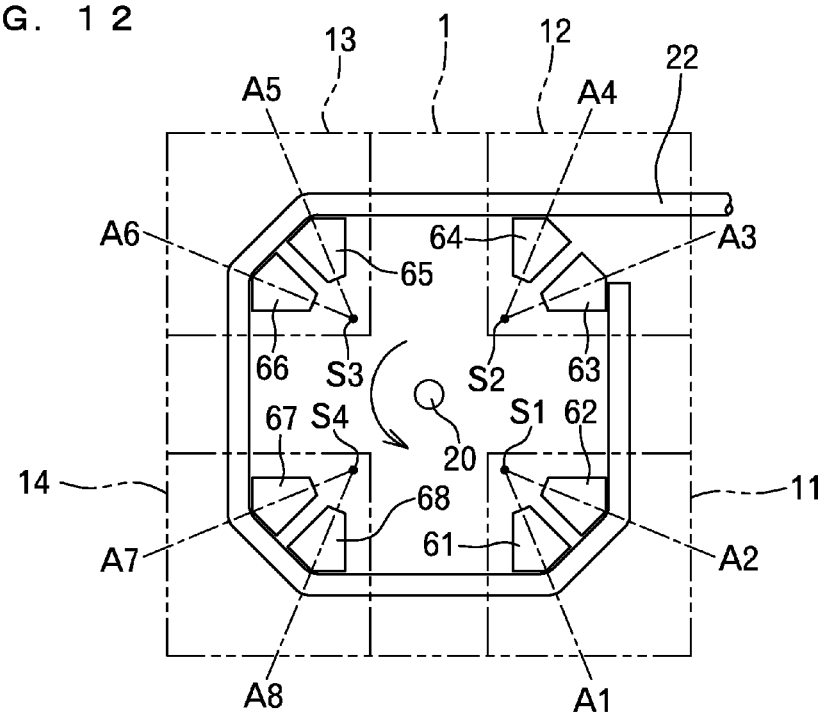
FIGS. 12(*a*) to (*b*) are front views showing a structure of major parts of an automatic winding machine for manufacturing the air core coil according to the second embodiment of the present invention, and actions of a plurality of winding core pieces.
Figure 12:
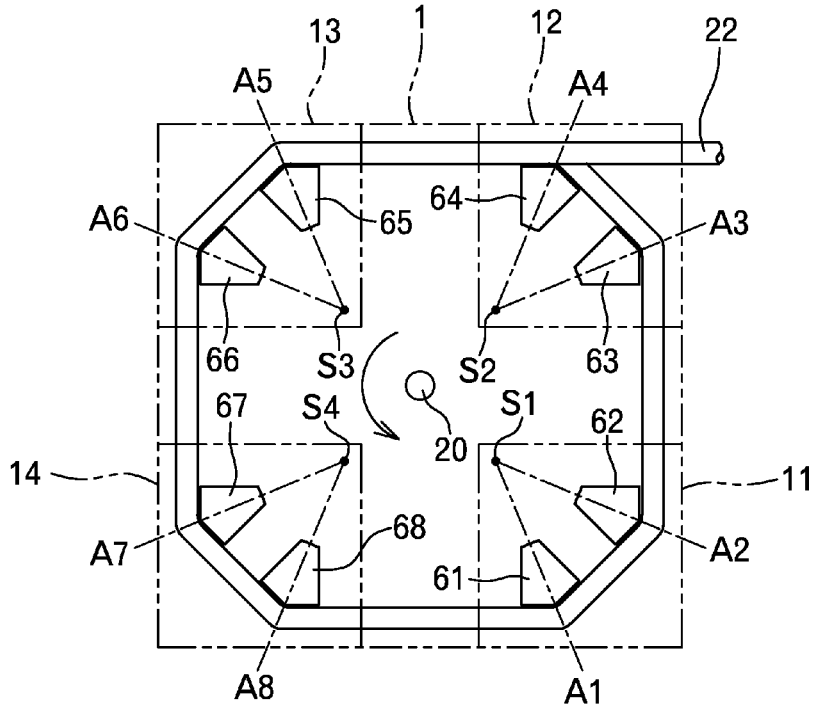

Thus, in the present embodiment, in place of the automatic winding machine 10 including the winding core shafts 31, 32, 33, 34 shown in FIG. 1, the automatic winding machine 1 shown in FIG. 12 is adopted. The automatic winding machine 1 is driven and rotated anticlockwise as shown by an arrow in the figure by a motor (not shown), and four winding core mechanisms 11, 12, 13, 14 are arranged at four corners thereof, respectively.

These four winding core mechanisms 11, 12, 13, 14 can be reciprocated in the direction of bringing away from the center foundation shaft 20 and in the direction of bringing close to the center foundation shaft 20 as well as the four winding core shafts 31, 32, 33, 34 shown in FIG. 1.

As shown in FIGS. 12(*a*)(*b*), the first winding core mechanism 11 includes a first winding core piece 61 driven and reciprocated along a straight line A1 extending outward from one point S1 on the center foundation shaft 20 side, and a second winding core piece 62 driven and reciprocated along a straight line A2 extending outward from the one point S1. The first winding core piece 61 and the second winding core piece 62 exert a function corresponding to the first winding core shaft 31 of the first embodiment.

The second winding core mechanism 12 includes a first winding core piece 63 driven and reciprocated along a straight line A3 extending outward from one point S2 on the center foundation shaft 20 side, and a second winding core piece 64 driven and reciprocated along a straight line A4 extending outward from the one point S2. The first winding core piece 63 and the second winding core piece 64 exert a function corresponding to the second winding core shaft 32 of the first embodiment.

The third winding core mechanism 13 includes a first winding core piece 65 driven and reciprocated along a straight line A5 extending outward from one point S3 on the side of the center foundation shaft 20, and a second winding core piece 66 driven and reciprocated along a straight line A6 extending outward from the one point S3. The first winding core piece 65 and the second winding core piece 66 exert a function corresponding to the third winding core shaft 33 of the first embodiment.

The fourth winding core mechanism 14 includes a first winding core piece 67 driven and reciprocated along a straight line A7 extending outward from one point S4 on the side of the center foundation shaft 20, and a second winding core piece 68 driven and reciprocated along a straight line A8 extending outward from the one point S3. The first winding core piece 67 and the second winding core piece 68 exert a function corresponding to the fourth winding core shaft 34 of the first embodiment.

The above eight winding core pieces 61 to 68 can be driven and reciprocated for example by installing a driving and reciprocating mechanism such as a solenoid for each of the winding core pieces in the winding core mechanisms.

Regarding each of the above eight winding core pieces 61 to 68, a surface on which the conductive wire 22 is wound is formed into a mountain shape having a vertex angle of 135 degrees. Therefore, by winding the conductive wire 22 on the pair of two winding core pieces, the two bent parts 25*a*, 25*a* of the first unit wound portion 25, the two bent parts 26*a*, 26*a* of the second unit wound portion 26, and the two bent parts 27*a*, 27*a* of the third unit wound portion 27 forming the corner parts of the air core coil 2 shown in FIG. 11 are formed.

As a result, a loop shape regulated by the surfaces of the eight winding core pieces 61 to 68 corresponds to a loop shape of the unit wound portions 25, 26, 27 of the air core coil 2 shown in FIG. 11.

Configurations of the automatic winding machine 1 of the air core coil 2 according to the second embodiment, the configurations being other than the above description are the same as the automatic winding machine 10 of the first embodiment shown in FIGS. 1 to 4.

In a wire winding step of the air core coil by the automatic winding machine 1 shown in FIG. 12, in a winding step of the unit coil portion 23, when the first unit wound portion 25 is wound, by fixing all the winding core pieces 61 to 68 at innermost circumferential positions as in FIG. 12(*a*) and rotating the automatic winding machine 1, the conductive wire 22 is wound around these winding core pieces 61 to 68. By successively winding the conductive wire 22 on the surfaces of the eight winding core pieces 61 to 68, the eight bent parts 26*a* to 26*a* of the second unit wound portion 26 are successively formed, and the bent angle of the bent parts is regulated to be 45 degrees.

Next, when the second unit wound portion 26 is wound, by moving all the winding core pieces 61 to 68 to the outer circumferential side by a wire diameter of the conductive wire 22 as in FIG. 12(*b*) and rotating the automatic winding machine 1 in that state, the conductive wire 22 is wound around these winding core pieces 61 to 68. By successively winding the conductive wire 22 on the surfaces of the eight winding core pieces 61 to 68, the eight bent parts 26*a* to 26*a* of the second unit wound portion 26 are successively formed, and the bent angle of the bent parts is regulated to be 45 degrees.

After that, when the third unit wound portion 27 is wound, by further moving all the winding core pieces 61 to 68 to the outer circumferential side by the wire diameter of the conductive wire 22 and rotating the automatic winding machine 1 in that state, the conductive wire 22 is wound around these winding core pieces 61 to 68. By successively winding the conductive wire 22 on the surfaces of the eight winding core pieces 61 to 68, the eight bent parts 27*a* to 27*a* of the third unit wound portion 27 are successively formed, and the bent angle of the bent parts is regulated to be 45 degrees.

In a winding step of the next unit coil portion 23, by rotating the automatic winding machine 1 while gradually moving all the winding core pieces 61 to 68 to the inner circumferential side by the wire diameter of the conductive wire 22, the conductive wire 22 is wound around these winding core pieces 61 to 68.

It should be noted that upon forming two continuous unit wound portions, after forming a first unit wound portion, while pushing out the conductive wire 22 of the unit wound portion from outer circumferential surfaces of the eight winding core pieces 61 to 68 by the conductive wire 22 to be a second unit wound portion, the conductive wire 22 to be the second unit wound portion is wound on the outer circumferential surfaces of the eight winding core pieces 61 to 68, and the second unit wound portion is formed.

Figure 16:
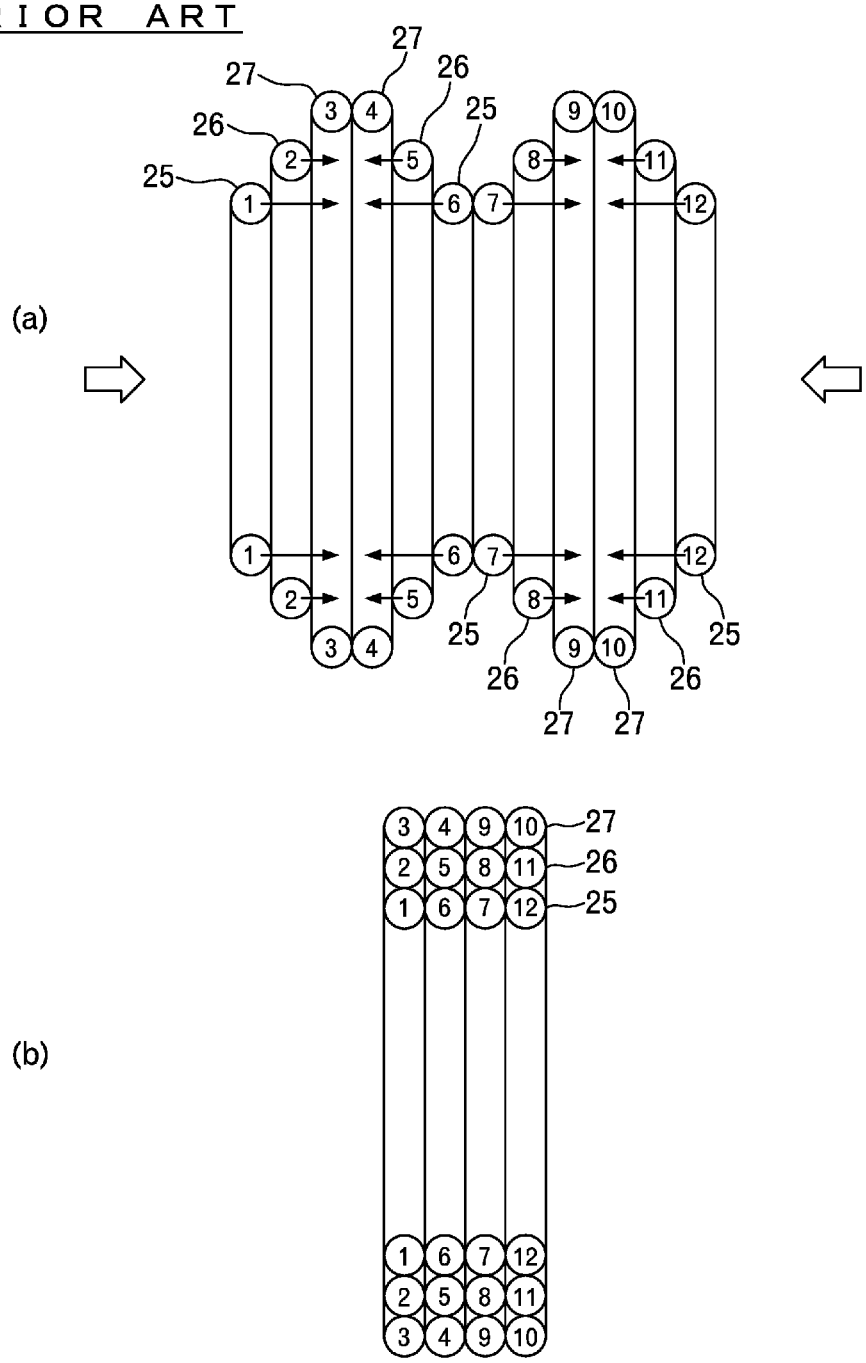
FIG. 16 PRIOR ART
FIGS. 16(*a*) to (*b*) are views showing a compressing step of the air core coil.

By repeating the above actions, an interim product of the air core coil shown in FIG. 11 is obtained. By compressing the interim product in the winding shaft direction as in FIGS. 16(*a*) and (*b*), the second unit wound portion 26 is pushed inside the third unit wound portion 27 and the first unit wound portion 25 is pushed inside the second unit wound portion 26, so that a finished product of the air core coil 2 shown in FIG. 11 is obtained.

In the air core coil 2 obtained in such a way, in the corner part 23*a* as shown in FIG. 11, the conductive wire of the first unit wound portion 25 and the conductive wire of the second unit wound portion 26 are in contact with each other over substantially entire lengths, and the conductive wire of the second unit wound portion 26 and the conductive wire of the third unit wound portion 27 are in contact with each other over substantially entire lengths. Therefore, the air core coil 2 has the space factor of the conductive wire larger than in the conventional air core coil 200 shown in FIG. 15.

It should be noted that the configurations of the parts of the present invention are not limited to the above embodiments but can be variously modified within the technical scope described in the claims. For example, a type and the number of times of winding of the unit wound portion are not limited to the above description as a matter of course. It should be understood that regarding the unit wound portion, the type may be two types of the above substantial oblong and the substantial trapezoid and the number of times of winding may be variously set as once, twice, or three times. The number of the bent parts of the unit wound portion in the corner part of the air core coil is not limited to two but may be plural numbers of three or more.

The conductive wire 22 is not limited to a round wire having a circular section but may be a square wire having a rectangular section.

DESCRIPTION OF REFERENCE CHARACTERS

1, 10 Automatic winding machine
2, 60 Air core coil
11-14 Winding core mechanism
20 Center foundation shaft
21 Winding assisting member
23 Unit coil portion
31-34 Winding core shaft
41-44 Slide lock
51-53 Pressing roller
55 Pressing trunk portion
56 Pressing plate
57 Shaft hole
61, 63, 65, 67 First winding core piece
62, 64, 66, 68 Second winding core piece
70 Conductive wire
76 Guide
77 Pusher member
80-84 Unit Wound Portion While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. An automatic winding machine configured to manufacture an air core coil in which unit coil portions formed by winding at least one conductive wire in a swirl form are repeatedly placed side by side in a winding shaft direction, each of the unit coil portions is formed by a plurality of unit wound portions having different inner circumferential lengths from each other, and when inserted to a core having a gap, at least a part of the unit wound portion having a small inner circumferential length is pushed inside the unit wound portion having a large inner circumferential length, the automatic winding machine comprising:

a rotation drive mechanism;

four winding core shafts protruding from the rotation drive mechanism and being rotated integrally with a rotation center of the rotation drive mechanism, the winding core shafts whose axial centers are parallel to the rotation center;

a reciprocating mechanism for sliding and moving the winding core shafts between a first position where the axial centers of the winding core shafts serve as apex positions of a substantial rectangle surrounding the rotation center and two facing sides connecting the winding core shafts are an inner circumferential length and an outer circumferential length, and a second position where the axial centers of the winding core shafts serve as apex positions of a substantial trapezoid whose outer circumferential length is the same as the first position and whose inner circumferential length is long, so as to bring the winding core shafts close to or away from the rotation center of the rotation drive mechanism;

at least one pressing roller biased in the direction of bringing close to a rotation passage of the winding core shafts from the outer circumferential side; and a conductive wire supply mechanism for continuously supplying the conductive wire between the winding core shafts and the pressing roller.

2. The automatic winding machine according to claim 1, comprising a pusher member arranged closely to the near side of the rotation direction of a position where the conductive wire supplied from the conductive wire supply mechanism is firstly abutted with any of the winding core shafts, the pusher member for pushing out the conductive wire wound around the winding core shafts to the free end side of the winding core shafts.

3. The automatic winding machine according to claim 1, wherein a center foundation shaft protruding over the winding core shafts is formed in the rotation center of the rotation drive mechanism, and a winding assisting member having a substantially rectangular section is detachably fitted onto the center foundation shaft.

4. A winding method of an air core coil in which unit coil portions formed by winding at least one conductive wire in a swirl form are repeatedly placed side by side in the winding shaft direction, each of the unit coil portions is formed by a plurality of unit wound portions having different inner circumferential lengths from each other, at least a part of the unit wound portion having a small inner circumferential length is pushed inside the unit wound portion having a large inner circumferential length, and each of the plurality of unit wound portions forming the unit coil portion is formed in a polygonal shape having a plurality of corner parts, wherein a plurality of winding core mechanisms matching with the number of the polygonal corner parts is arranged around a rotation shaft serving as the winding shaft so as to be driven and rotated about the rotation shaft, a plurality of winding core pieces reciprocatable in the direction of crossing the winding shaft is installed in each of the winding core mechanisms, the winding method has a first step of setting the pluralities of winding core pieces of the winding core mechanisms at predetermined positions; and a second step of winding the conductive wire around the pluralities of winding core pieces forming the winding core mechanisms by rotating the plurality of winding core mechanisms in a state that the pluralities of winding core pieces are set at the predetermined positions, and the plurality of unit wound portions forming one of the unit coil portions is formed by repeating the first step and the second step while changing the positions of the pluralities of winding core pieces in the direction of bringing away from the rotation shaft or in the opposite direction thereof in a plane orthogonal to the rotation shaft.

5. The winding method of the air core coil according to claim 4, wherein upon forming continuous first and second unit wound portions, after forming the first unit wound portion, while pushing out the unit wound portion from outer circumferential surfaces of the pluralities of winding core pieces by the conductive wire to be the second unit wound portion, the conductive wire to be the second unit wound portion is wound on the outer circumferential surfaces of the pluralities of winding core pieces, and the second unit wound portion is formed.

6. The winding method of the air core coil according to claim 4, wherein after the plurality of unit coil portions is formed by repeating the first step and the second step, by compressing the unit coil portions in the winding shaft direction, at least a part of the unit wound portion having a small inner circumferential length is pushed inside the unit wound portion having a large inner circumferential length, and the air core coil including a plurality of coil layers is completed.

7. The winding method of the air core coil according to claim 4, wherein a surface of each of the winding core pieces on which the conductive wire is wound is formed into a mountain shape having an obtuse vertex angle.

* * * * *